US010311777B2

(12) United States Patent
Huang et al.

(10) Patent No.: US 10,311,777 B2
(45) Date of Patent: Jun. 4, 2019

(54) CONTROL SYSTEM AND METHOD FOR DATA TRANSMISSION, CHIP ARRAY AND DISPLAY

(71) Applicant: LEYARD OPTOELECTRONIC CO., LTD., Beijing (CN)

(72) Inventors: Dong'an Huang, Beijing (CN); Changjun Lu, Beijing (CN); Shuo Zhang, Beijing (CN)

(73) Assignee: LEYARD OPTOELECTRONIC CO., LTD., Beijing (CN)

( * ) Notice: Subject to any disclaimer, the term of this patent is extended or adjusted under 35 U.S.C. 154(b) by 0 days.

(21) Appl. No.: 15/578,020

(22) PCT Filed: Feb. 26, 2016

(86) PCT No.: PCT/CN2016/074719
§ 371 (c)(1),
(2) Date: Nov. 29, 2017

(87) PCT Pub. No.: WO2016/192421
PCT Pub. Date: Dec. 8, 2016

(65) Prior Publication Data

US 2018/0293934 A1 Oct. 11, 2018

(30) Foreign Application Priority Data

May 29, 2015 (CN) ..... 2015 1 0290808

(51) Int. Cl.
*G09G 3/32* (2016.01)
*G09F 9/00* (2006.01)
(Continued)

(52) U.S. Cl.
CPC ..... *G09G 3/32* (2013.01); *G09F 9/00* (2013.01); *G09G 3/00* (2013.01); *G09G 3/2085* (2013.01);
(Continued)

(58) Field of Classification Search
CPC ..... G09G 3/2085; G09G 3/2088; G09G 3/3266–3291; G09G 3/3674–3692;
(Continued)

(56) References Cited

U.S. PATENT DOCUMENTS

2001/0003447 A1* 6/2001 Murai ..... G09G 3/3666 345/99
2004/0239586 A1 12/2004 Cok
(Continued)

FOREIGN PATENT DOCUMENTS

CN 101809644 A 8/2010
CN 101952820 A 1/2011
(Continued)

OTHER PUBLICATIONS

International Search Report for International Patent Application No. PCT/CN2016/074719 dated Jun. 1, 2016 (English language translation attached).
(Continued)

*Primary Examiner* — Nathan Danielsen
(74) *Attorney, Agent, or Firm* — Moore & Van Allen PLLC; Henry B. Ward, III

(57) ABSTRACT

Disclosed are a control system and method for data transmission, and a chip array and a display. The control system for data transmission comprises: a chip array, comprising a plurality of rows of chip assemblies, wherein any row of chip assembly includes at least two chip sets, all chips in each chip set are cascaded with each other; and a controller, configured to receive display data, and generate, according to the display data, a plurality of sets of display signals corresponding to the plurality of rows of chip assemblies, wherein any set of display signal is divided into at least two sub-display signals corresponding to the at least two chip sets, any sub-display signal accesses to a signal input end of
(Continued)

a first chip in a corresponding chip set. The control system and method for data transmission, and a chip array and a display solve the technical problem in the related art that electromagnetic radiation increases when a data transmission range is enlarged.

17 Claims, 1 Drawing Sheet

(51) Int. Cl.
*G09G 3/00* (2006.01)
*G09G 3/20* (2006.01)

(52) U.S. Cl.
CPC . *G09G 2300/0426* (2013.01); *G09G 2330/06* (2013.01)

(58) Field of Classification Search
CPC ... G09G 2310/0264; G09G 2310/0272; G09G 2310/0275; G09G 2310/0281; G09G 2310/0283; G09G 2310/0297; G09G 2330/06; G09G 2340/0442; G09G 2340/0464–0485; G09G 2360/04; G09G 2360/06; G09G 2360/12; G09G 2360/122
See application file for complete search history.

(56) References Cited

U.S. PATENT DOCUMENTS

| | | | | |
|---|---|---|---|---|
| 2007/0132701 | A1* | 6/2007 | Jeon | G09G 3/3611 345/100 |
| 2008/0074406 | A1* | 3/2008 | Matsumoto | G09G 3/20 345/204 |
| 2014/0240365 | A1 | 8/2014 | Kim et al. | |

FOREIGN PATENT DOCUMENTS

| | | | |
|---|---|---|---|
| CN | 102034432 | A | 4/2011 |
| CN | 103155202 | A | 6/2013 |
| CN | 104008724 | A | 8/2014 |
| CN | 104821154 | A | 8/2015 |
| CN | 204791900 | U | 11/2015 |
| JP | 08211846 | A2 | 8/1996 |
| JP | 11344955 | A2 | 12/1999 |
| JP | 2000163018 | A | 6/2000 |
| JP | WO2005013251 | A1 | 9/2006 |
| JP | 2009282516 | A2 | 12/2009 |
| JP | 2012508900 | A | 4/2012 |
| KR | 20140108376 | A | 9/2014 |
| TW | 200809715 | A | 2/2008 |

OTHER PUBLICATIONS

Written Opinion for International Patent Application No. PCT/CN2016/074719 dated Jun. 1, 2016 (English language translation attached).

Search Report issued by the State Intellectual Property Office of China dated Sep. 27, 2016, for corresponding Chinese Patent Application No. 201510290808.2.

Office Action issued by the Japanese Patent Office dated Aug. 7, 2018, for corresponding Japanese Patent Application No. 2017-562047.

Office Action issued by the Korean Intellectual Property Office dated Apr. 20, 2018, for corresponding Korean Patent Application No. 10-2016-7036036.

Office Action issued by the Korean Intellectual Property Office dated Aug. 22, 2018, for corresponding Korean Patent Application No. 10-2016-7036036.

Office Action issued by the Korean Intellectual Property Office dated Dec. 18, 2018, for corresponding Korean Patent Application No. 10-2016-7036036.

* cited by examiner

CONTROL SYSTEM AND METHOD FOR DATA TRANSMISSION, CHIP ARRAY AND DISPLAY

TECHNICAL FIELD

The disclosure relates to the field of control, more particularly to a control system and method for data transmission, a chip array and a display.

Background

A Light Emitting Diode (LED) display screen is a flat display, and includes a series of small LED module panels. Recently, due to strong applicability, rich colour, high light effect and long life, the LED display screen is quickly developed. Particularly, large-screen display is a huge market of LED applications.

Currently, a data transmission mode of the LED display screen refers to that: signals are respectively input to an input port of a first display chip in each row of chips in a chip array, wherein an output port of the first display chip is connected to an input port of a next chip; signals are transmitted sequentially according to a series structure sequentially formed by each row of chips, and a row of chips are controlled to be displayed. Aiming at the current connection mode, after a signal transmission speed is determined, a signal transmission range is limited within a certain time. When a larger signal transmission range is required, it is necessary to increase a signal transmission speed. However, after the signal transmission speed is increased, the problem of electromagnetic radiation increase will be caused, and the cost will be increased.

An effective solution has not proposed yet currently for the problem of electromagnetic radiation increases when a data transmission range is enlarged.

SUMMARY

The embodiments of the disclosure provide a control system and method for data transmission, a chip array and a display, which are intended to at least solve the technical problem in the related art that electromagnetic radiation increases when a data transmission range is enlarged.

According to one aspect of an embodiment of the disclosure, a control system for data transmission is provided, which may include: a chip array, including a plurality of rows of chip assemblies, wherein any row of chip assembly includes at least two chip sets, all chips in each chip set are cascaded with each other; and a controller, configured to receive display data, and generate, according to the display data, a plurality of sets of display signals corresponding to the plurality of rows of chip assemblies, wherein any set of display signal is divided into at least two sub-display signals corresponding to the at least two chip sets, any sub-display signal accesses to a signal input end of a first chip in a corresponding chip set.

According to an example embodiment, when any row of chip assembly includes two chip sets, a first chip set includes $2i-1^{th}$ chips in any row of chip assembly, and a second chip set includes $2i^{th}$ chips in any row of chip assembly, i being a natural number.

According to an example embodiment, a signal output end of a $j^{th}$ chip in the first chip set is connected to a signal input end of a $j+1^{th}$ chip in the first chip set, and a signal output end of a $j^{th}$ chip in the second chip set is connected to a signal input end of a $j+1^{th}$ chip in the second chip set, j being a natural number.

According to an example embodiment, when any row of chip assembly includes three chip sets, a first chip set includes $3i-2^{th}$ chips in any row of chip assembly, a second chip set includes $3i-1^{th}$ chips in any row of chip assembly, and a third chip set includes $3i^{th}$ chips in any row of chip assembly, i being a natural number.

According to an example embodiment, a signal output end of a $j^{th}$ chip in the first chip set is connected to a signal input end of a $j+1^{th}$ chip in the first chip set, a signal output end of a $j^{th}$ chip in the second chip set is connected to a signal input end of a $j+1^{th}$ chip in the second chip set, and a signal output end of a $j^{th}$ chip in the third chip set is connected to a signal input end of a $j+1^{th}$ chip in the third chip set, j being a natural number.

According to an example embodiment, the at least two sub-display signals formed by dividing any set of display signals are independent of each other in transmission, signal contents of the at least two sub-display signals being different from each other.

According to an example embodiment, any chip in the plurality of rows of chip assemblies corresponds to one display area.

According to an example embodiment, the display area includes a multi-row and multi-column pixel matrix included by a plurality of pixel units.

According to another aspect of an embodiment of the disclosure, a control method for data transmission is also provided, which may include that: acquiring display data; generating a plurality of sets of display signals according to the display data, wherein the plurality of sets of display signals correspond to a plurality of rows of chip assemblies in a chip array; and dividing any set of display signal into at least two sub-display signals, wherein any row of chip assembly includes at least two chip sets, the at least two sub-display signals correspond to the at least two chip sets, and the sub-display signal is configured to control a chip in a corresponding chip set.

According to an example embodiment, before generating the plurality of sets of display signals according to the display data, the method includes: determining the number of sets of the display signals according to the number of rows of the chip array.

According to an example embodiment, before dividing any set of display signal into the at least two sub-display signals, the method includes: determining the number of the sub-display signals according to the number of sets of any row of chip assembly.

According to an example embodiment, when the display signal is divided into two sub-display signals, a first sub-display signal is configured to control a first chip set, the first chip set including $2i-1^{th}$ chips in any row of chip assembly; and a second sub-display signal is configured to control a second chip set, the second chip set including $2i^{th}$ chips in any row of chip assembly, i being a natural number.

According to an example embodiment, when the display signals are divided into three sub-display signals, a first sub-display signal is configured to control a first chip set, the first chip set including $3i-2^{th}$ chips in any row of chip assembly; a second sub-display signal is configured to control a second chip set, the second chip set including $3i-1^{th}$ chips in any row of chip assembly; and a third sub-display signal is configured to control a third chip set, the third chip set including $3i^{th}$ chips in any row of chip assembly, i being a natural number.

According to another aspect of an embodiment of the disclosure, a chip array is also provided, which may include a plurality of rows of chip assemblies, wherein the plurality of rows of chip assemblies correspond to a plurality of sets of display signals, and any row of chip assembly includes at least two chip sets, the at least two chip sets corresponding to at least two sub-display signals formed by dividing any set of display signal in the plurality of sets of display signals.

According to an example embodiment, a signal input end of a first chip in any chip set is connected to a sub-display signal, and a signal output end of a $k^{th}$ chip in any chip set is connected to a signal output end of a $k+1^{th}$ chip in any chip set, k being a natural number.

According to another aspect of an embodiment of the disclosure, a display is also provided, which may include the control system for data transmission according to any item in the above solution.

According to another aspect of an embodiment of the disclosure, a display is also provided, which may include the chip array in the above solution.

In the embodiments of the disclosure, a chip array, including a plurality of rows of chip assemblies, wherein any row of chip assembly includes at least two chip sets, all chips in each chip set are cascaded with each other; and a controller, configured to receive display data, and generate, according to the display data, a plurality of sets of display signals corresponding to the plurality of rows of chip assemblies, wherein any set of display signal is divided into at least two sub-display signals corresponding to the at least two chip sets, any sub-display signal accesses to a signal input end of a first chip in a corresponding chip set. The technical problem, in the related art that electromagnetic radiation increases when a data transmission range is enlarged is solved.

BRIEF DESCRIPTION OF THE DRAWINGS

The drawings illustrated herein are used to provide further understanding of the disclosure, and form a part of the disclosure. The schematic embodiments and illustrations of the disclosure are used to explain the disclosure, and do not form improper limits to the disclosure. In the drawings.

DETAILED DESCRIPTION OF THE EMBODIMENTS

Figure 1:
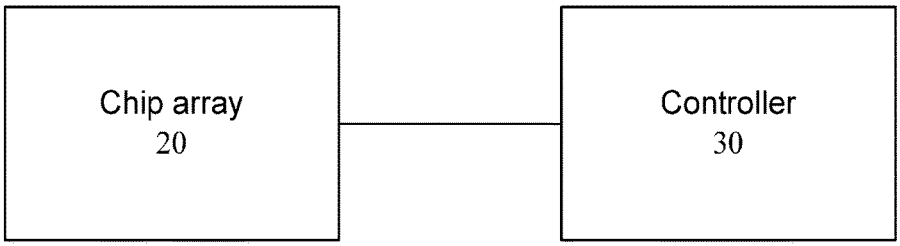
FIG. 1 is a schematic diagram of an example structural of the control system for data transmission according to the embodiment 1 of the disclosure.

In order to make those skilled in the art better understand the solutions of the disclosure, the technical solutions in the embodiments of the disclosure will be clearly and completely described below in conjunction with the drawings in the embodiments of the disclosure. Obviously, the described embodiments are only a part of the embodiments of the disclosure, not all of the embodiments. Based on the embodiments of the disclosure, all other embodiments obtained on the premise of no creative work of those skilled in the art shall fall within the protective scope of the disclosure.

It is important to note that the description and claims of the disclosure and terms 'first', 'second' and the like in the drawings are used to distinguish similar objects, and do not need to describe a specific sequence or a precedence order. It will be appreciated that data used in such a way may be exchanged under appropriate conditions, in order that the embodiments of the disclosure described here may be implemented in a sequence other than sequences graphically shown or described here. In addition, terms 'include' and 'have' and any inflexions thereof are intended to cover non-exclusive inclusions. For instance, it is not limited for processes, methods, systems, products or devices containing a series of steps or units to clearly list those steps or units, and other steps or units which are not clearly listed or are inherent to these processes, methods, products or devices may be included instead.

Embodiment 1

According to the embodiment of the disclosure, a control system for data transmission is provided.

FIG. 1 is a schematic diagram of an example structural of the control system for data transmission according to the embodiment 1 of the disclosure. The system includes:

a chip array 20, including a plurality of rows of chip assemblies, wherein any row of chip assembly includes at least two chip sets, all chips in each chip set are cascaded with each other.

According to an example embodiment, the specification of the chip array 20 may be pre-set according to actual requirements. For instance, the specification of the chip array is 20*10, where 20 may represent the number of rows of the chip array, and 10 may represent the number of columns of the chip array. The chip array may include a plurality of rows of chip assemblies. For instance, the 20*10 chip array includes 20 rows of chip assemblies. Any row of chip assembly may include a plurality of chip sets. For instance, each row of the 20*10 chip array includes 10 chips; when a row of chips are divided into two chip sets, under one situation, a first chip set may include a first chip, a third chip, a fifth chip, a seventh chip and a ninth chip, and a second chip set may include a second chip, a fourth chip, a sixth chip, an eighth chip and a tenth chip; and under another situation, the first chip set may include a first chip, a second chip, a third chip, a sixth chip and a ninth chip, and the second chip set may include a fourth chip, a fifth chip, a seventh chip, an eighth chip and a tenth chip. It is important to note that which chips are included in a chip set may be randomly set. A signal input end of each chip in a chip set is connected to a signal output end in sequence. For instance, when a chip set includes a first chip, a third chip, a fifth chip, a seventh chip and a ninth chip, a signal output end of the first chip is connected to a signal input end of the third chip, a signal output end of the third chip is connected to a signal input end of the fifth chip, a signal output end of the fifth chip is connected to a signal input end of the seventh chip, and a signal output end of the seventh chip is connected to a signal input end of the ninth chip.

Here, it is also important to note that any one chip in the chip array 20 may correspondingly control one display area. The display area may be a multi-row and multi-column pixel matrix included by a plurality of pixel units. For instance, one display area correspondingly controlled by one chip may be a 16*16 pixel matrix.

A controller 30 is configured to receive display data and generate, according to the display data, a plurality of sets of display signals corresponding to the plurality of rows of chip assemblies, wherein any set of display signal is divided into at least two sub-display signals corresponding to at least two chip sets, and any sub-display signal access to a signal input end of a first chip in a corresponding chip set.

According to an example embodiment, the controller 30 generates, according to the received display data, a plurality of sets of display signals, wherein any set of display signal in the plurality of sets of display signals is configured to control a row of chip assembly corresponding to the set of display signal. Any set of display signals in the plurality of sets of display signals may be divided into at least two sub-display signals, and the number of the sub-display signals may be determined according to the number of chip sets in the chip assemblies. For instance, when one chip assembly is divided into two chip sets, one set of display signal may be divided into two sub-display signals; and when one chip assembly is divided into three chip sets, one set of display signal may be divided into three sub-display signals.

In the embodiment of the disclosure, a chip array 20 includes a plurality of rows of chip assemblies, wherein any row of chip assembly includes at least two chip sets, all chips in each chip set are cascaded with each other; and a controller 30 is configured to receive display data and generate, according to the display data, a plurality of sets of display signals corresponding to the plurality of rows of chip assemblies, wherein any set of display signal is divided into at least two sub-display signals corresponding to the at least two chip sets, and any sub-display signal access to a signal input end of a first chip in the corresponding chip set. The technical problem, in the related art, of electromagnetic radiation increases when a data transmission range is enlarged is solved.

In an optional solution of the disclosure, when any row of chip assembly includes two chip sets, a first chip set includes $2i-1^{th}$ chips in any row of chip assembly, and a second chip set includes $2i^{th}$ chips in any row of chip assembly, wherein i is a natural number.

In an optional solution of the disclosure, a signal output end of a $j^{th}$ chip in a first chip set is connected to an input end of a $j+1^{th}$ chip in the first chip set, and a signal output end of a $j^{th}$ chip in a second chip set is connected to an input end of a $j+1^{th}$ chip in the second chip set, wherein j is a natural number.

Figure 2:
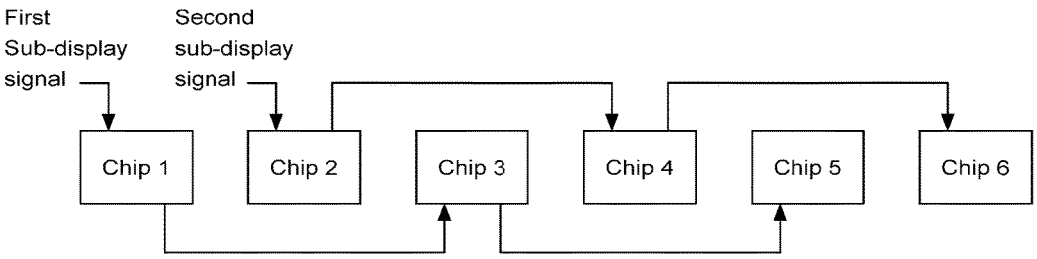
FIG. 2 is a schematic diagram of an example sub-display signal transmission where any row of chip assembly includes two chip sets according to an embodiment of the disclosure.

According to an example embodiment, FIG. 2 is a schematic diagram of an example sub-display signal transmission where any row of chip assembly includes two chip sets according to an embodiment of the disclosure. As shown in FIG. 2, a chip assembly including six chips is taken as an example. A first chip set includes a chip 1, a chip 3 and a chip 5 in a row of chip assembly, and a second chip set includes a chip 2, a chip 4 and a chip 6 in the row of chip assembly. The first chip set includes three chips, wherein a first sub-display signal access to a signal input end of the chip 1; and the second chip set includes three chips, a second sub-display signal access to a signal input end of the chip 2. A signal output end of a previous chip in one chip set is connected to a signal input end of a subsequent chip in the chip set to form cascaded connection.

In an optional solution of the disclosure, it is characterized in that when any row of chip assembly includes three chip sets, a first chip set includes $3i-2^{th}$ chips in any row of chip assembly, a second chip set includes $3i-1^{th}$ chips in any row of chip assembly, and a third chip set includes $3i^{th}$ chips in any row of chip assembly, wherein i is a natural number.

In an optional solution of the disclosure, it is characterized in that a signal output end of a $j^{th}$ chip in a first chip set is connected to a signal input end of a $j+1^{th}$ chip in the first chip set, a signal output end of a $j^{th}$ chip in a second chip set is connected to an input end of a $j+1^{th}$ chip in the second chip set, and a signal output end of a $j^{th}$ chip in a third chip set is connected to an input end of a $j+1^{th}$ chip in the third chip set, wherein j is a natural number.

According to an example embodiment, any row of chip assembly may include three chip sets. For instance, a first chip set includes a first chip, a fourth chip and a seventh chip in one row of chip assemblies, a second chip set includes a second chip, a fifth chip and an eighth chip in one row of chip assemblies, and a third chip set includes a third chip, a sixth chip and a ninth chip in one row of chip assemblies.

In an optional solution of the disclosure, at least two sub-display signals formed by dividing any set of display signal are independent of each other in transmission, and signal content of the at least two sub-display signals is different from each other.

According to an example embodiment, at least two sub-display signals formed by dividing any set of display signal are independent of each other in transmission. When the problem exists in a transmission process of a sub-display signal, other sub-display signals are not influenced by the sub-display signal, and may be still normally transmitted in a chip connection mode. Signal content of the at least two sub-display signals is different from each other, and a sum of the signal content forms display data of the set of display signals.

In the embodiment of the disclosure, a chip series-parallel mixed connection mode is adopted, signals are enabled to be transmitted in accordance with a series-parallel mixed method, and one row of display data are controlled by using multiple sub-display signals. Thus, in the case of a certain transmission speed, the display range of the chip array 20 is multiply larger than that of series chips, the aim of controlling a larger range in the case of a lower transmission speed of a signal is achieved, and electromagnetic radiation can be effectively reduced due to the low transmission speed of the signal.

Embodiment 2

According to the embodiment of the disclosure, a control method for data transmission is provided. It is important to note that the steps shown in the flowchart in the drawings may be executed in a computer system including a set of computer executable instructions, and moreover, although a logical sequence is shown in the flowchart, the shown or described steps may be executed in a sequence different from the sequence here under certain conditions.

Figure 3:
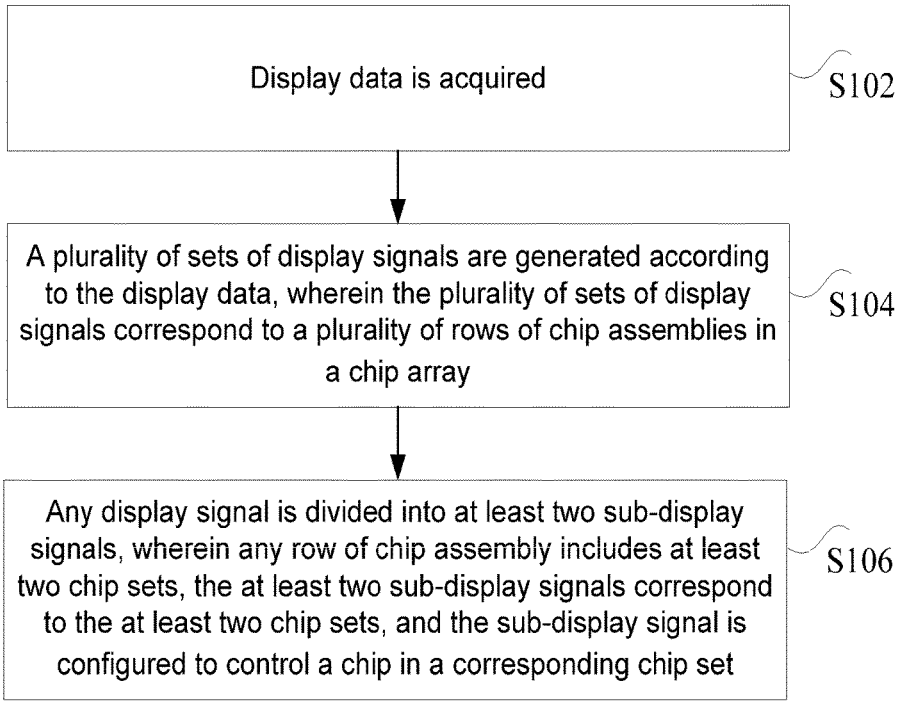
FIG. 3 is a flowchart of an example control method for data transmission according to the embodiment 2 of the disclosure.

FIG. 3 is an optional flowchart of a control method for data transmission according to an embodiment 2 of the disclosure. As shown in FIG. 3, the method includes the steps as follows.

Step S102: Display data is acquired.

Step S104: A plurality of sets of display signals are generated according to the display data, wherein the plurality of sets of display signals correspond to a plurality of rows of chip assemblies in a chip array.

According to an example embodiment, a controller generates, according to the received display data, a plurality of sets of display signals, wherein any set of display signal in the plurality of sets of display signals is configured to control a row of chip assemblies corresponding to the set of display signal. The specification of the chip array may be pre-set according to actual requirements. The chip array may include a plurality of rows of chip assemblies. For instance, a 20*10 chip array may include 20 rows of chip assemblies.

Step S106: Any display signal is divided into at least two sub-display signals, wherein any row of chip assembly includes at least two chip sets, the at least two sub-display signals correspond to the at least two chip sets, and the sub-display signal is configured to control a chip in a corresponding chip set.

According to an example embodiment, any set of display signal in a plurality of sets of display signals may be divided into at least two sub-display signals, and the number of the sub-display signals may be determined according to the number of chip sets in chip assemblies. Any row of chip assembly may include a plurality of chip sets. For instance, each row of a 20*10 chip array includes 10 chips; when a row of chips are divided into two chip sets, under a situation, a first chip set may include a first chip, a third chip, a fifth chip, a seventh chip and a ninth chip, and a second chip set may include a second chip, a fourth chip, a sixth chip, an eighth chip and a tenth chip; and under another situation, the first chip set may include a first chip, a second chip, a third chip, a sixth chip and a ninth chip, and the second chip set may include a fourth chip, a fifth chip, a seventh chip, an eighth chip and a tenth chip. It is important to note that which chips are included in a chip set may be randomly set. A signal input end of each chip in a chip set is connected to a signal output end in sequence. For instance, when a chip set includes a first chip, a third chip, a fifth chip, a seventh chip and a ninth chip, a signal output end of the first chip is connected to a signal input end of the third chip, a signal output end of the third chip is connected to a signal input end of the fifth chip, a signal output end of the fifth chip is connected to a signal input end of the seventh chip, and a signal output end of the seventh chip is connected to a signal input end of the ninth chip. When a chip assembly is divided into two chip sets, a set of display signals may be divided into two sub-display signals; and when a chip assembly is divided into three chip sets, a set of display signals may be divided into three sub-display signals.

Here, it is also important to note that any chip in the chip array may correspondingly control a display area. The display area may be a multi-row and multi-column pixel matrix included by a plurality of pixel units. For instance, a display area correspondingly controlled by a chip may be a 16*16 pixel matrix.

In Step S102, display data is acquired; in Step S104, a plurality of sets of display signals are generated according to the display data, wherein the plurality of sets of display signals correspond to a plurality of rows of chip assemblies in a chip array; and in Step S106, any set display signal is divided into at least two sub-display signals, wherein any row of chip assembly includes at least two chip sets, the at least two sub-display signals correspond to the at least two chip sets, and the sub-display signal is configured to a control chip in a corresponding chip set. The technical problem, in the related art, of electromagnetic radiation increases when a data transmission range is enlarged is solved.

In an optional solution of the disclosure, before Step S104 that the plurality of sets of display signals are generated according to the display data, the method provided by the embodiment may include that:

Step S1031: the number of sets of control signals is determined according to the number of rows of the chip array.

According to an example embodiment, before the controller displays a signal, the number of rows of chip arrays may be read first, such that the number of sets of generated display signals may be equal to the number of the rows of the chip arrays.

In an optional solution of the disclosure, before Step S106 that any display signal is divided into at least two sub-display signals, the method provided by the embodiment may include that:

Step S1051: the number of the sub-display signals is determined according to the number of sets of any row of chip assembly.

According to an example embodiment, before the display signals are divided into at least two sub-display signals, the number of chip sets in any row of chip assembly may be read, such that the number of the generated sub-display signals may be equal to the number of the chip sets.

In an optional solution of the disclosure, when a display signal is divided into two sub-display signals, the first sub-display signal is configured to control a first chip set, wherein the first chip set includes $2i-1^{th}$ chips in any row of chip assembly; and the second sub-display signals may be configured to control a second chip set, wherein the second chip set includes $2i^{th}$ chips in any row of chip assembly, i being a natural number.

According to an example embodiment, as shown in FIG. 2, a chip assembly including six chips is taken as an example. A first chip set includes a chip 1, a chip 3 and a chip 5 in one row of chip assemblies, and a second chip set includes a chip 2, a chip 4 and a chip 6 in one row of chip assemblies. The first chip set includes three chips, wherein a first sub-display signal access to a signal input end of the chip 1; and the second chip set includes three chips, wherein a second sub-display signal access to a signal input end of the chip 2. A signal output end of a previous chip in one chip set is connected to a signal input end of a subsequent chip in the chip set to form cascaded connection.

In an optional solution of the disclosure, when the display signal is divided into three sub-display signals, a first sub-display signal is configured to control a first chip set, wherein the first chip set includes $3i-2^{th}$ chips in any row of chip assembly; the second sub-display signal is configured to control a second chip set, wherein the second chip set includes $3i-1^{th}$ chips in any row of chip assembly; and the third sub-display signal is configured to control a third chip set, wherein the third chip set includes $3i^{th}$ chips in any row of chip assembly, i being a natural number.

According to an example embodiment, any row of chip assembly may include three chip sets. For instance, a first chip set includes a first chip, a fourth chip and a seventh chip in one row of chip assemblies, a second chip set includes a second chip, a fifth chip and an eighth chip in one row of chip assemblies, and a third chip set includes a third chip, a sixth chip and a ninth chip in one row of chip assemblies.

In an optional solution of the disclosure, the at least two sub-display signals formed by dividing the random set of display signal are independent of each other in transmission, and signal content of the at least two sub-display signals is different from each other.

In the embodiment of the disclosure, a chip series-parallel mixed connection mode is adopted, signals are enabled to be transmitted in accordance with a series-parallel mixed method, and one row of display data is controlled by using multiple sub-display signals. Thus, in the case of a certain transmission speed, the display range of the chip array is multiply larger than that of series chips, the aim of controlling a larger range in the case of a lower transmission speed of a signal is achieved, and electromagnetic radiation may be effectively reduced due to the low transmission speed of the signal.

Embodiment 3

According to the embodiment of the disclosure, a chip array is provided.

The chip array includes a plurality of rows of chip assemblies. The plurality of rows of chip assemblies correspond to a plurality of sets of display signals, and any row of chip assembly includes at least two chip sets, wherein the at least two chip sets correspond to at least two sub-display signals formed by dividing any set of display signal in a plurality of sets of display signals, a signal input end of a first chip in each chip set is connected to a sub-display signal, and a signal output end of a $k^{th}$ chip in the chip sets is connected to a signal output end of a $k+1^{th}$ chip in the chip sets, k being a natural number.

According to an example embodiment, the specification of the chip array may be pre-set according to actual requirements. For instance, the specification of the chip array is 20*10, where 20 may represent the number of rows of the chip array, and 10 may represent the number of columns of the chip array. The chip array may include a plurality of rows of chip assemblies. For instance, the 20*10 chip array includes 20 rows of chip assemblies Any row of chip assembly may include a plurality of chip sets. For instance, each row of the 20*10 chip array includes 10 chips; when a row of chips are divided into two chip sets, under one situation, a first chip set may include a first chip, a third chip, a fifth chip, a seventh chip and a ninth chip, and a second chip set may include a second chip, a fourth chip, a sixth chip, an eighth chip and a tenth chip; and under another situation, the first chip set may include a first chip, a second chip, a third chip, a sixth chip and a ninth chip, and the second chip set may include a fourth chip, a fifth chip, a seventh chip, an eighth chip and a tenth chip. It is important to note that which chips are included in a chip set may be randomly set. A signal input end of each chip in a chip set is connected to a signal output end in sequence. For instance, when a chip set includes a first chip, a third chip, a fifth chip, a seventh chip and a ninth chip, a signal output end of the first chip is connected to a signal input end of the third chip, a signal output end of the third chip is connected to a signal input end of the fifth chip, a signal output end of the fifth chip is connected to a signal input end of the seventh chip, and a signal output end of the seventh chip is connected to a signal input end of the ninth chip.

Here, it is important to note that any one chip in the chip array may correspondingly control one display area. The display area may be a multi-row and multi-column pixel matrix included by a plurality of pixel units. For instance, a display area correspondingly controlled by a chip may be a 16*16 pixel matrix Here, it is also important to note that a controller generates, according to received display data, a plurality of sets of display signals, wherein any set of display signal in the plurality of sets of display signals is configured to control a row of chip assemblies corresponding to the set of display signal. Any set of display signal in the plurality of sets of display signals may be divided into at least two sub-display signals, and the number of the sub-display signals may be determined according to the number of chip sets in the chip assemblies. For instance, when one row of chip assembly is divided into two chip sets, one set of display signals may be divided into two sub-display signals; a signal output end of a $k^{th}$ chip in a first chip set is connected to a signal input end of a $k+1^{th}$ chip in the first chip set, and a signal output end of a $k^{th}$ chip in a second chip set is connected to an input end of a $k+1^{th}$ chip in the second chip set. When one set chip assembly is divided into three chip sets, one set of display signals may be divided into three sub-display signals. A signal output end of a $k^{th}$ chip in a first chip set is connected to an input end of a $k+1^{th}$ chip in the first chip set, a signal output end of a $k^{th}$ chip in a second chip set is connected to a signal input end of a $k+1^{th}$ chip in the second chip set, and a signal output end of a $k^{th}$ chip in a third chip set is connected to an input end of a $k+1^{th}$ chip in the third chip set.

The chip array includes a plurality of rows of chip assemblies. The plurality of rows of chip assemblies correspond to a plurality of sets of display signals, and any row of chip assembly includes at least two chip sets, wherein the at least two chip sets correspond to at least two sub-display signals formed by dividing any display signal in a plurality of sets of display signals, a signal input end of a first chip in each chip set is connected to a sub-display signal, and a signal output end of a $k^{th}$ chip in any chip set is connected to a signal output end of a $k+1^{th}$ chip in the chip set, k being a natural number The technical problem, in the related art, of electromagnetic radiation increases when a data transmission range is enlarged is solved.

Embodiment 4

According to the embodiment of the disclosure, a display is provided. The display includes the control system for data transmission according to any optional solution in the embodiment 1.

Embodiment 5

According to the embodiment of the disclosure, a display is provided The display includes the chip array according to any optional solution in the embodiment 3.

The serial numbers of the embodiments of the disclosure are only used for descriptions, and do not represent the preference of the embodiments.

In the above embodiments of the disclosure, descriptions of each embodiment are emphasized respectively, and parts which are not elaborated in detail in a certain embodiment may refer to relevant descriptions of other embodiments.

In some embodiments provided by the disclosure, it will be appreciated that the disclosed technical contents may be implemented in other modes, wherein the apparatus embodiment described above is only schematic. For instance, division of the units may be division of logical functions, and there may be additional division modes during actual implementation. For instance, a plurality of units or components may be combined or integrated to another system, or some features may be omitted or may be not executed. In addition, displayed or discussed mutual coupling or direct coupling or communication connection may be performed via some interfaces, and indirect coupling or communication connection between units or modules may be in an electrical form or other forms.

The units illustrated as separate parts may be or may not be physically separated. Parts for unit display may be or may not be physical units. That is, the parts may be located at a place or may be distributed on a plurality of units. The aims of the solutions of the embodiments may be achieved by selecting some or all units according to actual requirements.

In addition, all function units in all embodiments of the disclosure may be integrated in a processing unit, or each unit may exist separately and physically, or two or more units may be integrated in a unit. The integrated unit may be implemented in a hardware form or may be implemented in a software function unit form.

If the integrated unit is implemented in the software function unit form and is sold or used as an independent product, the product may be stored in a computer readable storage medium. Based on this understanding, the technical solutions of the disclosure may be substantially embodied in a software product form or parts contributing to the related art or all or some of the technical solutions may be embodied in the software product form, and a computer software product is stored in a storage medium, including a plurality of instructions enabling a computer device, which may be a personal computer, a server or a network device, to execute all or some of the steps of the method according to each embodiment of the disclosure. The storage medium includes: various media capable of storing program codes, such as a U disk, a Read-Only Memory (ROM), a Random Access Memory (RAM), a mobile hard disk, a magnetic disk or an optical disc.

The control system and method for data transmission, the chip array and the display according to the disclosure are described in an exemplar mode with reference to the drawings as above. However, those skilled in the art shall understand that various improvements may be made on the control system and method for data transmission, the chip array and the display provided by the disclosure without departing from the contents of the disclosure.

The above is only preferred implementations of the disclosure. It shall be pointed out that those skilled in the art may also make some improvements and modifications without departing from the principle of the disclosure. These improvements and modifications shall fall within the protective scope of the disclosure.

What is claimed is:

1. A control system for data transmission, comprising:

a chip array, comprising a plurality of rows of chip assemblies, wherein a first row of the plurality of chip assemblies comprises three chip sets, all chips in each of the three chip sets are cascaded with each other;

a controller, configured to receive display data, and generate, according to the display data, a plurality of sets of display signals corresponding to the plurality of rows of chip assemblies, wherein at least one set of the plurality of sets of display signals is divided into three sub-display signals corresponding to the three chip sets, each of the three sub-display signals is applied to a signal input end of a first chip in each of the three chip sets; and wherein a first chip set in the first row comprises $3i-2^{th}$ chips, a second chip set in the first row comprises $3i-1^{th}$ chips, and a third chip set in the first row comprises $3i^{th}$ chips, i being a natural number.

2. The system as claimed in claim 1, wherein when any a second row of the plurality of chip assemblies comprises two chip sets, a first chip set in the second row comprises $2k-1^{th}$ chips, and a second chip set in the second row comprises $2k^{th}$ chips, k being a natural number.

3. The system as claimed in claim 2, wherein a signal output end of a $j^{th}$ chip in the first chip set in the second row is connected to a signal input end of a $j+1^{th}$ chip in the first chip set in the second row, and a signal output end of a $j^{th}$ chip in the second chip set in the second row is connected to a signal input end of a $j+1^{th}$ chip in the second chip set in the second row, j being a natural number.

4. The system as claimed in claim 3, wherein each chip in the plurality of rows of chip assemblies corresponds to one display area.

5. The system as claimed in claim 2, wherein each chip in the plurality of rows of chip assemblies corresponds to one display area.

6. The system as claimed in claim 1, wherein a signal output end of a $j^{th}$ chip in the first chip set in the first row is connected to a signal input end of a $j+1^{th}$ chip in the first chip set in the first row, a signal output end of a $j^{th}$ chip in the second chip set in the first row is connected to a signal input end of a $j+1^{th}$ chip in the second chip set in the first row, and a signal output end of a $j^{th}$ chip in the third chip set in the first row is connected to a signal input end of a $j+1^{th}$ chip in the third chip set in the first row, j being a natural number.

7. The system as claimed in claim 1, wherein the at least two sub-display signals formed by dividing each set of display signals are independent of each other in transmission, signal contents of the at least two sub-display signals being different from each other.

8. The system as claimed in claim 1, wherein each chip in the plurality of rows of chip assemblies corresponds to one display area.

9. The system as claimed in claim 8, wherein the display area comprises a multi-row and multi-column pixel matrix comprised by a plurality of pixel units.

10. A display, comprising the control system for data transmission as claimed in claim 1.

11. A control method for data transmission, comprising:

acquiring display data;

generating a plurality of sets of display signals according to the display data, wherein the plurality of sets of display signals correspond to a plurality of rows of chip assemblies in a chip array;

dividing each set of display signals into at least two sub-display signals, wherein each row of chip assemblies comprises at least two chip sets, the at least two sub-display signals correspond to the at least two chip sets, and each sub-display signal is configured to control at least one chip in each corresponding chip set; and wherein, in a first row of the plurality of rows of chip assemblies comprising three chip assemblies, the display signals are divided into three sub-display signals, a first of the three sub-display signals is configured to control a first chip set in the first row, the first chip set comprising $3i-2^{th}$ chips; a second of the three sub-display signals is configured to control a second chip set in the first row, the second chip set comprising $3i-1^{th}$ chips; and a third of the three sub-display signals is configured to control a third chip set in the first row, the third chip set comprising $3i^{th}$ chips, i being a natural number.

12. The method as claimed in claim 11, wherein before generating the plurality of sets of display signals according to the display data, the method comprises:

determining the number of sets of the display signals according to the number of rows of the chip array.

13. The method as claimed in claim 11, wherein before dividing each set of display signal into the at least two sub-display signals, the method comprises:

determining the number of the sub-display signals according to the number of sets of each row of chip assembly.

14. The method as claimed in claim 11, wherein, in a second row of the plurality of chip assemblies comprising two chip assemblies, the display signal is divided into two sub-display signals, a first of the two sub-display signals is configured to control a first chip set in the second row, the first chip set in the second row comprising $2k-1^{th}$ chips; and a second of the two sub-display signals is configured to control a second chip set in the second row, the second chip set in the second row comprising $2k^{th}$ chips, k being a natural number.

15. A chip array, comprising:

a plurality of rows of chip assemblies, wherein the plurality of rows of chip assemblies correspond to a plurality of sets of display signals, and a first row of the chip assemblies comprises three chip sets, the three chip sets corresponding to three sub-display signals formed by dividing a first set of display signals in the plurality of sets of display signals; and wherein a first chip set in the first row comprises $3i-2^{th}$ chips, a second chip set in the first row comprises $3i-1^{th}$ chips, and a third chip set in the first row comprises $3i^{th}$ chips, i being a natural number.

16. The chip array as claimed in claim 15, wherein a signal input end of a first chip in each chip set is connected to a sub-display signal, and a signal output end of a $k^{th}$ chip in each chip set is connected to a signal input end of a $k+1^{th}$ chip in each chip set, k being a natural number.

17. A display, comprising the chip array as claimed in claim 15.

* * * * *